US005146483A

United States Patent [19]

Behling

[11] Patent Number: 5,146,483

[45] Date of Patent: Sep. 8, 1992

[54] ROTARY ANODE X-RAY TUBE

[75] Inventor: Rolf Behling, Norderstedt, Fed. Rep. of Germany

[73] Assignee: U.S. Philips Corporation, New York, N.Y.

[21] Appl. No.: 717,303

[22] Filed: Jun. 18, 1991

[30] Foreign Application Priority Data

Jun. 20, 1990 [DE] Fed. Rep. of Germany ..... 4019614

[51] Int. Cl.[5] ..... H01J 35/10

[52] U.S. Cl. ..... 378/127; 378/132; 378/142

[58] Field of Search ..... 378/127, 126, 119, 123, 378/131, 132, 141, 142, 143, 144, 199, 200, 202, 128

[56] References Cited

U.S. PATENT DOCUMENTS 3,753,021 8/1973 Braun ..... 313/60
3,790,836 2/1974 Braun ..... 378/127
4,614,445 9/1986 Gerkema et al. ..... 384/368

FOREIGN PATENT DOCUMENTS 0141476 11/1984 European Pat. Off. .
591625 1/1934 Netherlands .

*Primary Examiner*—Constantine Hannaher
*Assistant Examiner*—Don Wong

[57] ABSTRACT

A rotary anode stem tube is secured to a bearing by a coupling arrangement including a nested body and shaft, the shaft being thermally conductively coupled to the stem tube and the body being thermally conductively coupled to the bearing. The body and shaft have a relatively large interface region in facing spacing relation. Different positions of the interface region engage in thermally conductive relation in accordance with the temperature of the stem tube to selectively increase the thermal conductivity of the shaft to the body and selectively decrease the cooling time of the stem tube without an unacceptable increase in the bearing temperature.

19 Claims, 1 Drawing Sheet

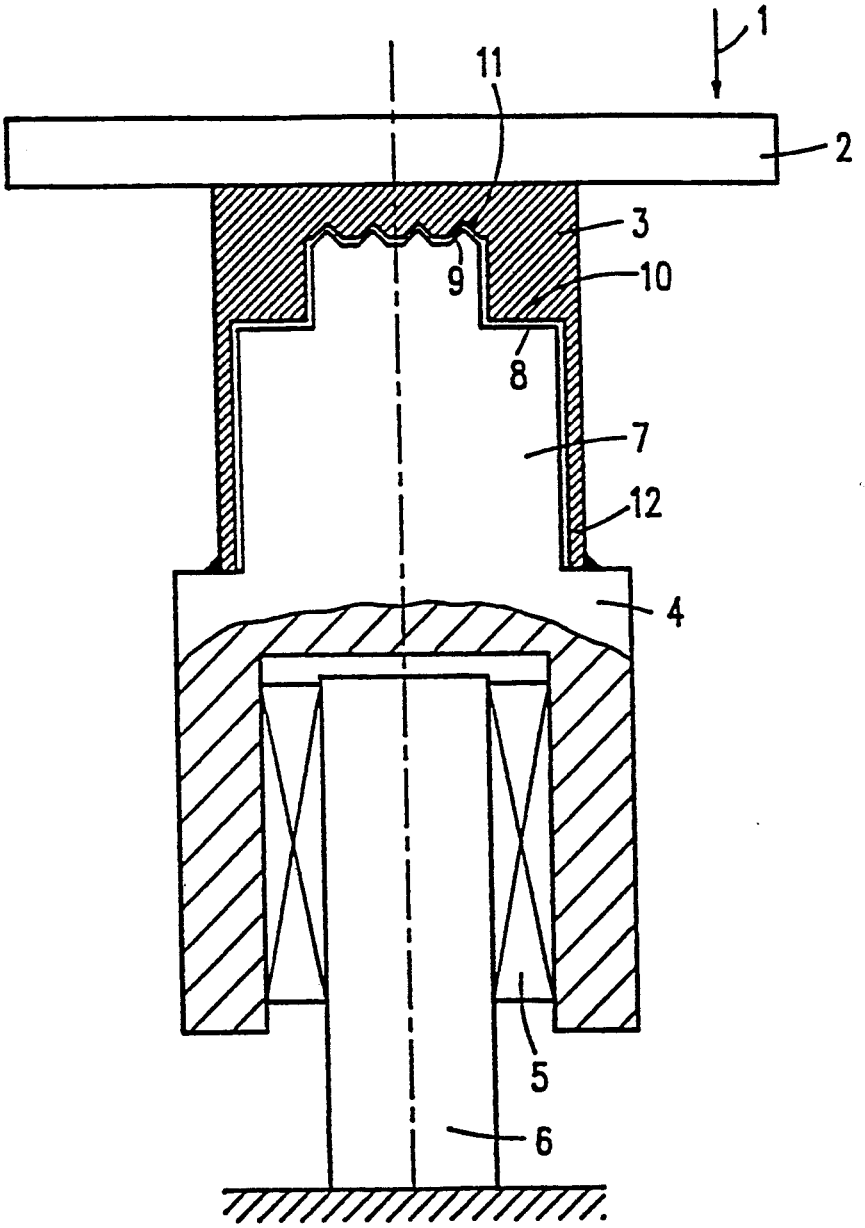
1
11
2
3
9
10
8
7
12
4
5
6

ROTARY ANODE X-RAY TUBE

FIELD OF THE INVENTION

The invention relates to a rotary anode X-ray tube comprising means for varying the heat resistance of the heat dissipation path dissipating the heat from the rotary anode stem tube through the bearing.

BACKGROUND OF THE INVENTION

In such an arrangement known from DE-PS 591 625, in the stationary condition an anode part is brought into good thermally conducting contact with a heat-dissipating body.

When the X-ray tube is switched on, the striking electron beam produces in the rotary anode stem tube a high heat dissipation, which can lead there to a temperature of, for example 1500° C. Before the tube is switched on again, a cooling to, for example, 150° C. must take place in order that, when the tube is subsequently switched on again, the occurrence of too high temperatures is avoided.

It is attempted to keep the required cooling time (in dependence upon the application, for example, approximately 20 minutes) as short as possible. At high temperature, the dissipated heat is conducted away from the anode stem tube mainly by radiation. At low temperatures, on the contrary, essentially only the heat transport through the material of the rotary anode and via the bearing to a bearing support dissipating heat to the environment is left. More particularly with the use of sliding bearings, this path can contribute essentially to shortening of the required cooling time of the rotary anode stem tube.

A substantial reduction of the heat resistance of the heat dissipation path, though permanent or, above known case described in the only in the stationary condition, can lead to unacceptable high bearing temperatures, however.

SUMMARY OF THE INVENTION

The invention has for its object to construct a rotary anode X-ray tube of the kind mentioned in the opening paragraph in such a manner that the cooling time of the rotary anode stem tube is shortened without the risk of the bearing temperature assuming unacceptable high values.

This object is achieved in that a device is provided, by which the variation of the heat resistance is obtained in dependence upon the temperature variation of a part following the rotation occurring after the electron beam has been switched off.

The heat resistance is first reduced with a given time delay. The temperature of the rotary anode stem tube has then already considerably decreased due to heat emission to a value which, in spite of the subsequently reduced heat resistance, can no longer lead to high bearing temperatures.

According to a preferred particularly reliable embodiment, the variation of the heat resistance is obtained by the temperature variation in a part in good thermally conducting connection with the rotary anode stem tube. As control criterion, use is made of a temperature varying uniformly with the temperature of the rotary anode stem tube and primarily ensuring the heating of the bearing. However, it is also possible to use the temperature of a part in thermally conducing connection with the bearing as criterion for the variation of the heat resistance.

A control device provided in accordance with the invention consists in general form of a sensor sensing the temperature and of a drive for moving at least one part having a contact surface.

Preferably, the control device can comprise an element expanded in dependence upon temperature. A particularly simple embodiment that can be obtained thereby is characterized in that the variable heat resistance consists of two parts, which have corresponding adjacent contact surfaces, which can be moved with respect to each other by thermal expansion of at least one of the elements. A single part constructed in a simple manner then fulfils simultaneously the functons of the sensor and of the drive.

An advantageous constructive embodiment is characterized in that the variable resistance is arranged in the interior of a tubular shaft connecting the rotary anode stem tube with a rotor body, in that the shaft has at least one contact surface, and in that at least one opposite contact surface is arranged at a projection extending within the shaft and being in good thermally conducting contact with the rotor body.

According to an advantageous further embodiment of the invention, it is ensured that the shaft has such an axial length and such a small wall thickness that its heat resistance from the rotary anode stem tube to the rotor body is higher than 30% of the heat resistance obtained due to the bearing. The heat resistances of the shaft and the variable heat resistance precede in parallel arrangement the heat resistance of the bearing. Comparatively large arrangements of the resulting heat resistance are obtained if the ratio of the heat resistances of the shaft and of the bearing is as large as possible.

In order that the heat transport through the contact surfaces is not impeded by the formation of thermally isolating foreign layers, it is ensured that the quality of the contact surfaces is improved.

The heat contact resistance over the contact surfaces is inversely proportional to the size of the contact surface and to the pressure force. An enlargement of the effective contact surface can be attained in that the contact surfaces have associated depressed parts and embossed parts, respectively.

In order that the invention may be readily carried out, it will now be described more fully, by way of example, with reference to the accompanying drawing.

BRIEF DESCRIPTION OF THE DRAWING

The sole FIGURE shows diagrammatically the essential parts of a rotary anode constructed in accordance with the invention.

DESCRIPTION OF THE PREFERRED EMBODIMENT

To a radially external region of a rotary anode stem tube 2 is directed a concentrated electron beam 1, which originates from a cathode (not shown) and produces an X-ray radiation. A high heat dissipation leading to temperature of up to 1500° C. is then obtained in the rotary anode stem tube 2.

The rotary anode stem tube 2 is soldered through the shaft 3 to the rotor body 4 so as to be locked against rotation. The rotor body 4 is journalled on the stationary and preferably cooled bearing support 6 through an indicated sliding bearing 5 (as described in principle in EP-A 14 14 76).

The rotor body 4 acts as a shortcircuit rotor, on which an asynchronous torque is exerted by means of a rotary field formed by a motor stator (not shown). The motor stator is outside a mainly metallic and gas-tight housing (not shown) surrounding the elements shown in the FIGURE, as is well known.

Due to the high temperatures of the rotary anode stem tube 2 of approximately 1500° C., the shaft 3 is heated to about 800° C., the rotor body 4 is heated to about 400° C. and the bearing support 6 is heated to about 200° C., temperatures averaged over the volume areas being indicated, which, when the thermal parallel path is interrupted, are adjusted through the projection 7 of the rotor body 4.

The projection 7 is arranged within the hollow cylindrical shaft 3 in spaced relation as shown over a first portion of their respective facing structures, for example, the nested portion of projection 7 in shaft 3. The projection 7 has contact surfaces 8 and 9, to which correspond contact surfaces 10 and 11, respectively, of the shaft 3. The contact surfaces 8 and 10 are flat surfaces over a second portion, for example, of their respective structures, in the form of circular rings. The contact surfaces 9 and 11 on the contrary are over a third portion and are uneven and are provided with annular embossed indentations, respectively, which indentations have an approximately triangular cross-section. As a result, the effective heat contact surface is enlarged at surfaces 9 and 11.

In the condition shown in the FIGURE, which is obtained at high temperature values of the rotary anode stem tube 2, the contact surfaces 8 and 10 and 9 and 11, respectively, are located opposite to each other at small relative distances. These distances are shown on an exaggerated large scale in the drawing. (Apart from heat radiation) no heat is conducted over the separation fold and the vacuum. Since the shaft 3 is constructed over a long axial path with a very small wall thickness 12, its heat resistance to the rotor body 4 is high. For example, the heat resistance due to the axial length and wall thickness of shaft 3 may be higher by 30% of the heat resistance of the bearing body 5. Consequently, only a small part of the temperature of the rotary anode stem tube 2 can act upon the bearing body 5.

At a temperature of the rotary anode stem tube 2 decreasing particularly due to heat emission, the temperature of the shaft 3 also decreases, which then shrinks axially. At a temperature of the rotary anode stem tube 2 of about 20% of its maximum temperature, the contact surfaces 8 and 10 and 9 and 11, respectively, adjoin each other. Heat is then transmitted through the contact surfaces. The cooling of the shaft 3 is then accelerated and on the other hand the projection 7 is heated. Consequently, a large elastic pressure force is then rapidly produced between the contact surfaces, which results in a very low heat resistance from the shaft 3 through the contact surfaces 8 and 10 and 9 and 11, respectively, to the rotor body 4. The further cooling of the rotary anode stem tube 12 to about 10% of its maximum temperature is considerably acclerated. At the now low temperature level there is no risk of the temperature of the bearing 5 assuming unacceptable values.

The distances between the respective contact surfaces 8 and 10 and 9 and 11 can be dimensioned so differently that contacts are obtained at different times and at different temperatures of the rotary anode stem tube 2. As a result, a further reduction of the overall cooling time of the rotary anode stem tube 2 can be attained.

It is further possible to utilize radial temperature expansions for bridging cylindrical gaps between the stem 3 and the projection 7.

What is claimed is:

1. A rotary anode X-ray tube comprising a rotary anode stem tube coupled to a bearing and means for varying the heat-resistance of a heat-dissipation path dissipating the heat from the rotary anode stem tube through the bearing, said means for varying the heat resistance including means for coupling said tube to said bearing, said means for coupling exhibiting temperature variations and including means for varying the heat resistance between the stem tube and bearing in dependence upon the temperature variation of said means for coupling.

2. A rotary anode X-ray tube as claimed in claim 1 wherein said means for varying the heat resistance comprises means in thermally conducting connection with the rotary anode stem tube.

3. A rotary anode X-ray tube as claimed in claim 1 wherein said means for varying the heat resistance comprises means in thermally conducting connection with the bearing.

4. A rotary anode X-ray tube as claimed in claim 1 wherein said means for varying the heat resistance comprises at least one element whose dimensions vary due to the temperature variation.

5. A rotary anode X-ray tube as claimed in claim 1 wherein said means for varying the heat resistance comprises two elements which have corresponding adjacent contact surfaces, which surfaces can be moved along each other due to thermal expansion of at least one of the elements.

6. A rotary anode X-ray tube as claimed in claim 1 wherein the X-ray tube comprises a tubular shaft connecting the rotary anode stem tube with a rotor body, said means for varying the heat resistance comprising at least one contact surface on said shaft and at least one opposite contact surface thermally conductively coupled to said stem tube arranged at a projection extending within the shaft and being in thermally conducting connection with the rotor body.

7. A rotary anode X-ray tube as claimed in claim 6 wherein the shaft has such an axial length and such a small wall thickness that its heat resistance from the rotary anode stem tube to the rotor body is higher than 30% of the heat resistance of the bearing.

8. A rotary anode X-ray tube as claimed in one of claim 5 wherein the contact surfaces have associated respective depressed parts and embossed parts.

9. A rotary anode X-ray tube as claimed in claim 3 wherein said means for varying the heat resistance comprises at least one element whose dimensions vary due to the temperature variation.

10. A rotary anode X-ray tube as claimed in claim 9 wherein said means for varying the heat resistance comprises two elements which have corresponding adjacent contact surfaces, which surfaces can be moved along each other due to thermal expansion of at least one of the elements.

11. A rotary anode X-ray tube as claimed in claim 9 wherein the X-ray tube comprises a tubular shaft connecting the rotary anode stem tube with a rotor body, said means for varying the heat resistance comprising at least one contact surface on said shaft and at least one opposite contact surface thermally conductively coupled to said stem tube arranged at a projection extending within the shaft and being in good thermally conducting connection with the rotor body.

12. A rotary anode X-ray tube as claimed in claim 11 wherein the shaft has such an axial length and such a small wall thickness that its heat resistance from the rotary anode stem tube to the rotor body is higher than 30% of the heat resistance of the bearing.

13. A rotary anode X-ray tube as claimed in claim 10 wherein the contact surfaces have associated respective depressed parts and embossed parts.

14. A rotary anode X-ray tube as claimed in claim 6 wherein the contact surfaces have associated respective depressed parts and embossed parts.

15. A rotary anode X-ray tube as claimed in claim 11 wherein the contact surfaces have associated respective depressed parts and embossed parts.

16. A rotary anode X-ray tube as claimed in claim 12 wherein the contact surfaces have associated respective depressed parts and embossed parts.

17. A rotary anode X-ray tube as claimed in claim 7 wherein the contact surfaces have associated respective depressed parts and embossed parts.

18. A rotary anode X-ray tube comprising:

a rotary anode stem tube exhibiting different temperatures;

a bearing; and means for securing the stem tube to the bearing;

said means for securing including means for thermally conducting heat from said stem tube to said bearing, said means for thermally conducting heat having a heat resistance that changes in value in accordance with the temperature of said stem tube.

19. The rotary anode tube of claim 18 wherein said means for thermally conducting includes nested first and second elements, the first element being thermally coupled to the bearing, the second element being thermally conductively coupled to said stem tube, said first and second elements being in spaced relation over a first portion of the surfaces thereof, at least one second portion of said first portion engaging in thermal conductive relation in accordance with the temperature of said stem tube.

* * * * *